US007698867B1

(12) United States Patent
Stucko et al.

(10) Patent No.: US 7,698,867 B1
(45) Date of Patent: Apr. 20, 2010

(54) SIDING TRIM CLIP WITH TRIANGULAR GRIPPING PATTERN

(76) Inventors: Craig B. Stucko, 11 Wenmore Rd., Commack, NY (US) 11725; Harald Schmidt, 8 S. Meadow Glen Rd., Kings Park, NY (US) 11754

( * ) Notice: Subject to any disclaimer, the term of this patent is extended or adjusted under 35 U.S.C. 154(b) by 188 days.

(21) Appl. No.: 11/762,086

(22) Filed: Jun. 13, 2007

(51) Int. Cl.
*E04D 1/34* (2006.01)
*E04F 13/00* (2006.01)

(52) U.S. Cl. ..... 52/548; 52/712; 52/716.8; 52/718.06; 52/520; 24/293

(58) Field of Classification Search ..... 52/276, 52/465, 516, 518, 519, 543, 557, 520, 712, 52/547, 548; 24/293–295, 545; D8/289, D8/294, 395
See application file for complete search history.

(56) References Cited

U.S. PATENT DOCUMENTS

| | | | | | |
|---|---|---|---|---|---|
| 1,941,216 | A | * | 12/1933 | McKeown | 52/545 |
| 2,060,739 | A | | 11/1936 | Maddux | |
| 2,517,122 | A | * | 8/1950 | Lockwood | 52/548 |
| 3,351,206 | A | * | 11/1967 | Wennerstrom | 210/474 |
| 3,371,900 | A | * | 3/1968 | Jacobs | 248/343 |
| 3,512,222 | A | | 5/1970 | Tinnerman | |
| 3,673,643 | A | * | 7/1972 | Kindell | 24/458 |
| 4,296,530 | A | * | 10/1981 | Muller et al. | 24/295 |
| 4,854,101 | A | * | 8/1989 | Champagne | 52/520 |
| 4,887,785 | A | * | 12/1989 | Blaich | 248/339 |
| 4,947,609 | A | * | 8/1990 | Champagne | 52/545 |
| 4,978,091 | A | * | 12/1990 | Anderson et al. | 248/74.3 |
| 4,979,714 | A | * | 12/1990 | Russell et al. | 248/303 |
| 5,355,646 | A | * | 10/1994 | Bischel et al. | 52/489.1 |
| 5,537,791 | A | | 7/1996 | Champagne | |
| 5,564,246 | A | * | 10/1996 | Champagne | 52/548 |
| 5,606,835 | A | * | 3/1997 | Champagne | 52/545 |
| 5,634,314 | A | | 6/1997 | Champagne | |
| 5,675,955 | A | | 10/1997 | Champagne | |
| 6,234,835 | B1 | * | 5/2001 | Bakker et al. | 439/553 |
| 6,367,220 | B1 | * | 4/2002 | Krause et al. | 52/512 |
| 6,883,288 | B1 | | 4/2005 | Harbin | |
| 6,988,345 | B1 | | 1/2006 | Pelfrey et al. | |
| 7,093,394 | B1 | | 8/2006 | McNamara et al. | |
| 2002/0174618 | A1 | * | 11/2002 | Carroll | 52/520 |
| 2004/0182039 | A1 | * | 9/2004 | Bess | 52/698 |
| 2005/0262792 | A1 | | 12/2005 | Walda | |

OTHER PUBLICATIONS

Windward Engineering, Mechanical Drawing of "Clip", Rev A, Never Published.

* cited by examiner

*Primary Examiner*—Robert J Canfield
(74) *Attorney, Agent, or Firm*—Island Patent; F. Scott Tierno

(57) ABSTRACT

A siding trim clip having a substantially N-shaped profile is formed having a first gripping portion and a second biasing portion. The gripping portion includes a curved upper arch having an interior with opposing inwardly and upwardly oriented gripping fingers, arranged for accepting and securing an edge location of a siding member by way of a triangular gripping pattern. The biasing portion includes a lower inverted arch and linear portions for providing an outward biasing of the edge location of a siding member to hold it away from a wall structure and up against an outside edge of a pre-established finishing cavity. This abstract is provided to comply with rules requiring an abstract, and is submitted with the intention that it will not be used to interpret or limit the scope and meaning of the claims.

20 Claims, 8 Drawing Sheets

SIDING TRIM CLIP WITH TRIANGULAR GRIPPING PATTERN

TECHNICAL FIELD

The presently disclosed invention relates most generally to siding accessories and trim structures. More particularly, the present invention relates to an improved siding trim clip useful for securing upper portions of a typically cut and reduced height siding panel member.

BACKGROUND

Siding systems useful for providing a protective and aesthetic covering are well known in the art, and are often available in a number of differing types. For example, as shown in FIG. 1, the siding members 104 may be structured to look like traditional lap boards. Alternately, another common siding choice, as shown in FIG. 2, provides a textured cedar simulated siding member. As depicted in FIGS. 1 and 2, the actual siding members include an upper panel interlocking portion 108*a*, which is structured to mate with a lower panel interlocking portion 108*b*. For the first piece, a starter piece 110 is employed and includes slots or holes 114. First the starter piece 110 is attached to the wall structure 90 using fasteners 112, as depicted. Next a first course of siding members, 104 or 104-1, are installed upon the wall structure 90.

As understood by skilled persons, one issue that arises with the installation of common and ubiquitous vinyl and synthetic siding, is the need to secure upper edge locations which have often been trimmed (e.g., cut to fit the wall structure). For example, such an arrangement typically occurs at a vertical stop location, such as under pre-hung windows and under over-hangs of common residential and commercial structures.

One common approach employed by siding technicians, which is simple and relatively low cost, involves the use of point-location applications of silicone sealant at somewhat equally spaced locations along the edge location to be secured. The siding technician would simply load up a finishing trim piece such as J-channel with a 'blob' of silicone, say every 12 to 18 inches. Next the panel would be installed, relying on the interlocking bottom portion to initially hold the panel up while the blob of silicone dries. Although a simple technique, involving no additional mechanical and or mating pieces, this solution does not provide a firm holding of the panel, especially during severe weather conditions such as those involving high wind speeds.

When considering common sidings, they can be made of a thin material, say having a thickness of 1/32 of an inch to 1/4 of an inch. The prior art provides a variety of trim clip structures for certain (generally flexible and thin) siding materials. For example, the trim clip of Champagne (U.S. Pat. No. 5,537,791) may be best suited for use with thin and ubiquitous common double-siding members. However, trim clips such as those taught by Champagne can be somewhat complicated, often having a number of sharp bends, which are substantially folds of material, along with several additional sharp obtuse angle bends. A major issue is known to arise with trim clips such as those taught by Champagne, especially when they are employed with thicker siding materials. Essentially, the sharp bends employed to assure an effective gripping of an edge location of a thinner siding member, makes prior art trim clips (e.g., Champagne) difficult to use—if not functionally inoperative—when used with thicker versions of common vinyl and synthetic siding members. In addition, prior art trim clips such as the Champagne' clip, employ a limited grasping/gripping arrangement wherein typically only one line of gripping fingers is applied to each side at the edge to be secured. This provides a less than optimal gripping arrangement that is quite susceptible to rocking, and which is notably improved upon by the 'triangular gripping pattern' employed with embodiments of the present invention.

Accordingly, there is a need for an improved trim clip, wherein the clip may be used with a variety of siding panel members having differing thicknesses and textures. Further, it would be helpful to have a trim clip that does not employ sharp bends and or folds, which tend to be rigid and or somewhat less flexible, while also possibly compromising the material at the location of the fold/sharp bend. It would also be desirable to have a plurality of gripping fingers that are most preferably arranged to engage the edge location of a siding panel member to be secured using at least three (3) lines of fingers—most preferably gripping the edge of the panel in a triangular gripping relationship or pattern. A number of other characteristics, advantages, and or associated novel features of the present invention, will become clear from the description and figures provided herein. Attention is called to the fact, however, that the drawings are illustrative only. In particular, the embodiments included and described, have been chosen in order to best explain the principles, features, and characteristics of the invention, and its practical application, to thereby enable skilled persons to best utilize the invention and a wide variety of embodiments providable that are based on these principles, features, and characteristics. Accordingly, all equivalent variations possible are contemplated as being part of the invention, limited only by the scope of the appended claims.

SUMMARY OF PREFERRED EMBODIMENTS

In accordance with the present invention, an improved siding trim clip is disclosed having a substantially (capital) n-shaped profile, and in most applications is preferably formed of a single strip of a monolithic material. Although adaptable to numerous and varied uses, the trim clip of the invention is certainly structured to enable a cut or upper finishing edge of a siding member to be securely fastened to, and firmly held within, a finishing cavity such as common J-channel or L-channel finishing members. Importantly, the preferred embodiments disclosed and claimed are very capable of securing edge locations of common heavy gauge siding materials, including common double clapboard vinyl siding members, as well as simulated cedar siding panel members. Further, the most preferred embodiments of the improved siding trim clip are structured with a first gripping portion and a second biasing portion. The gripping portion includes a curved upper arch having an interior with gripping fingers extending inwardly and upwardly, from preferably three locations. As will be discussed hereinafter, the interior of the gripping portion is arranged for accepting and securing a typically cut edge or edge location (of a siding member). Once the required number of trim clips are installed upon the edge location of the siding member, the edge and trim clips are inserted and secured within a pre-established finishing cavity. It should be noted that the finishing cavity may be provided by a variety of possible and available structures. In a most simple arrangement a pre-established finishing cavity may be provided by installing finishing members, such as common J-channel trim pieces. The finishing cavity may be needed along a structure's intersecting line between a wall and an overhang, which may be termed a 'vertical stop'. Other common locations that employ typically elongated trim/finishing cavities include under window sills, and around door frames.

The biasing portion of the trim clip, which is physically located substantially behind the siding member once the trim clip is installed upon the edge location, includes a lower inverted arch and linear portions for providing an outward biasing mechanism. Importantly, when the trim clip is installed upon an edge or edge location, the gripping portion will grasp and secure the clip to the siding member, while the biasing portion is structured for simultaneously biasing the edge location away from a wall structure to which the siding member is being installed upon. In addition, the biasing portion will also aid in securing and holding the trim clip and edge location within the finishing cavity.

One preferred structural arrangement employable with an exemplary embodiment of the present invention calls for a first gripping portion having a first substantially linear portion establishing a first end of the trim clip. The first substantially linear portion is structured having an inward radius bend formed proximate to a first end of the first substantially linear portion, which may also be termed a first end of the trim clip. An opposite end of the first substantially linear portion is coupled to (or transitions into) an acute (inside) angle upper radius bend, which is provided at an upper most portion of the first gripping portion. Importantly, the upper radius bend is a smooth curve, not having any sharp bends, creases, or folds. Completing the gripping portion of this preferred embodiment is at least:

a) an upper portion of a middle substantially linear portion; and b) a plurality of inwardly and upwardly oriented gripping fingers.

It may be noted that the middle substantially linear portion is clearly coupled to the first substantially linear portion by way of the interposed upper radius bend.

Similarly to the gripping portion, the biasing portion is arranged with a lower (inverted and curved) arch including an integral acute angle lower radius bend. The lower inverted arch is interposed between, and acts as a coupling, for the lower portion of the middle substantially linear portion and a third substantially linear portion. The third substantially linear portion, which is the portion of the trim clip that generally contacts a rearward surface of a finishing cavity or wall structure, also provides an inwardly curved end, physically provided at the second end of the trim clip. Importantly, the most preferred embodiments of the trim clip of the present invention will have inward curves formed at each of the first end and the second end of the trim clip, with a more substantive and longer bend (curvature) provided at the first end when compared to the inward radius curve of the second end.

Returning to the gripping portion of the trim clip of the invention, a gripping means is required for securing the edge portion or location within the interior of the gripping portion. For example, one exemplary, simple, and low cost embodiment of a gripping means may be provided by a plurality of upwardly facing gripping fingers, formed extending inwardly, within the interior of the upper arch of the gripping portion. When considering a most preferred embodiment of the gripping means, a plurality of gripping fingers are provided at three locations so as to form at least one triangular gripping pattern. The triangular gripping pattern is arranged with at least two spaced gripping fingers structured for contacting and gripping a first surface of a siding member, proximate to an edge location, while at least one other finger is structured for contacting the siding member upon a second surface of the siding member. The first side gripping fingers are structured for engaging and gripping the edge location on an opposite side to the second side gripping fingers. A more detailed definition of the triangular gripping pattern will be provided hereinafter in significant depth.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

PARTIAL LIST OF REFERENCE NUMERALS

Figure 1:
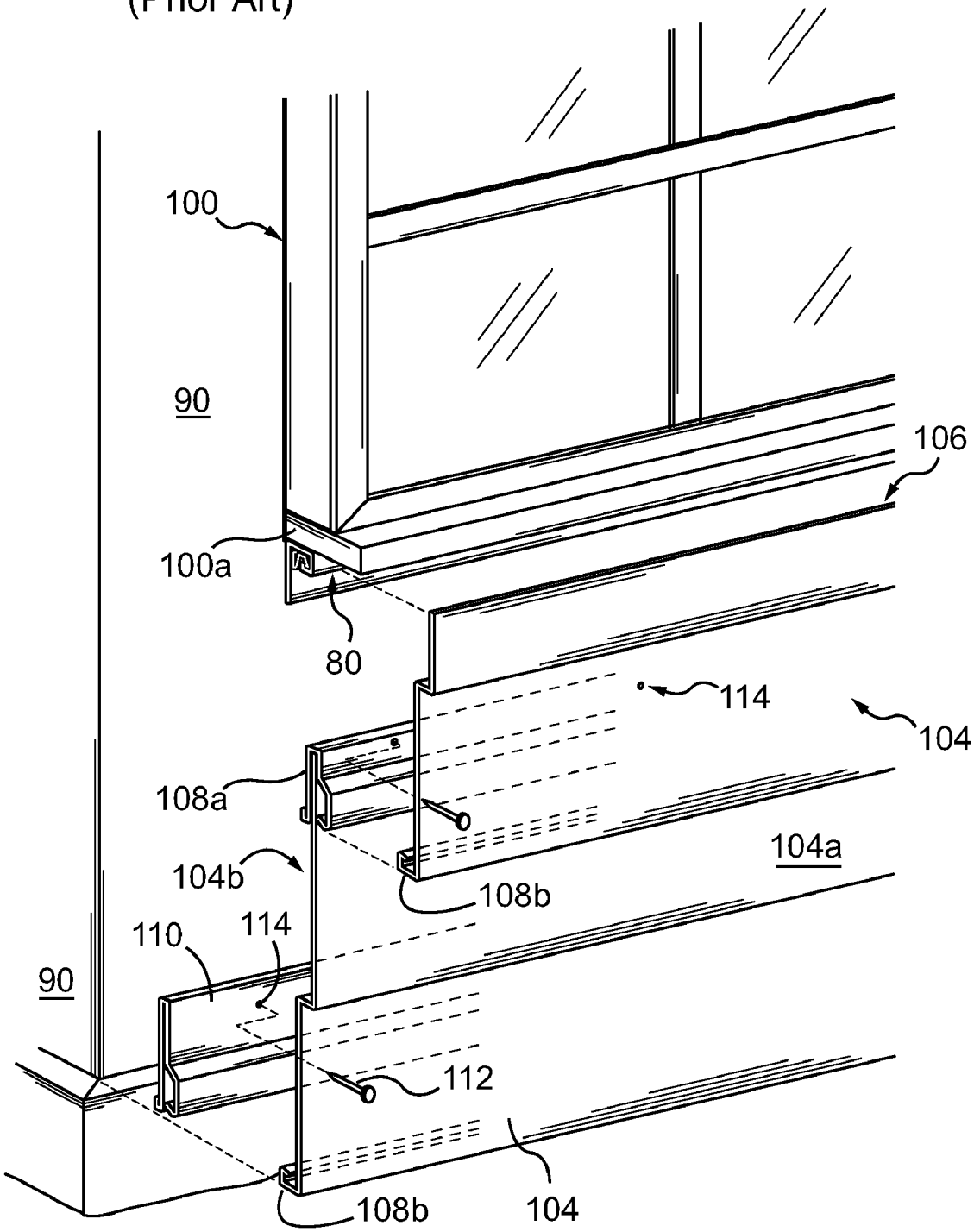
FIG. 1 (Prior Art)
FIG. 1 depicts a prior art siding arrangement and a common 'cut-edge' trim/finishing issue.
Figure 2:
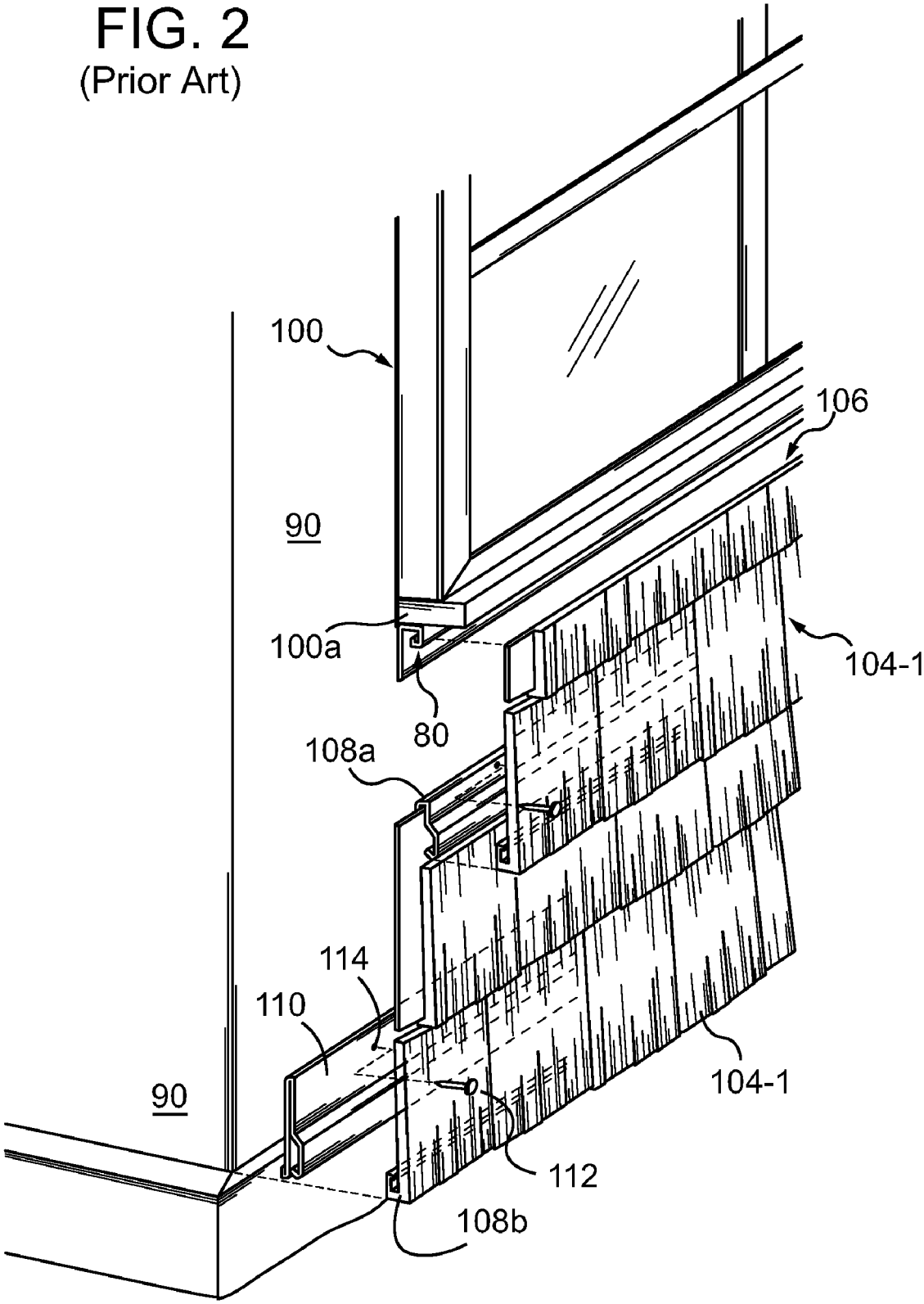
FIG. 2 (Prior Art)
FIG. 2 depicts a thicker siding board, with an upper edge, which as with the depiction of FIG. 1, requires a means to securely and cleanly grip and hold the edge within a trim piece.

10—N-shaped trim clip
14—first inward radius bend (of 20)
16—(first end) gripping fingers
18—gripping portion
18*a*—interior (of 18)
20—first substantially linear portion
24—acute angle upper radius bend
26—gripping fingers (of 20)
30—middle substantially linear portion
34—acute angle lower radius bend
36—gripping fingers (of 30)
38—biasing portion
40—third substantially linear portion
42—void or opening
44—second inward curved end portion (of 40)
50—triangular gripping pattern
60*a*—opening
60*b*—reduction in width
80—(common/standard) J-channel trim

90—wall structure
100—window frame
100*a*—window sill
104—standard siding member (panel)
104*a*—first or outer side (of 104)
104*b*—second or inner side (of 104)
106—edge or edge location (of 104)
108*a*—upper panel interlocking portion-A
108*b*—lower panel interlocking portion-B
110—starter piece
112—fastener
114—hole or slot (for 112)
A1-A4—curved (inside) radius bend angles
R1-R4—radius lengths (for A1-A4)

DETAILED DESCRIPTION OF EMBODIMENTS OF THE INVENTION

It is important to establish the definition of a number of descriptive terms and expressions that will be used throughout this disclosure. The term 'siding member' is intended to include any of a variety of commonly available siding products, and equivalents thereof. Examples include common double lap board and simulated cedar siding, which may be made of vinyl or other available and suitable materials. For example, composite material siding boards are also contemplated as possible siding members compatible with the invention. The terms 'edge' and 'edge location', which may be considered equivalents when referring to portions of siding members 104, may indicate either a factory edge portion or location, but in practice will more often refer to a custom cut edge (e.g., resulting from a cut or rip made at the site of installation to match a wall/structure). A 'finishing cavity', and equivalently an 'elongated finishing cavity', is a structure well known to skilled persons, into which the trim clip 10 of the present invention (and an edge location of a siding member) may be installed and secured. A most preferred and economical embodiment of a popular finishing cavity may be provided with common siding trim members such as lengths of J-channel trim 80 and or L-channel trim, which are often fixed along vertical stops. A common vertical stops include locations such as under overhangs and under window frames 100 (or equivalently window sills 100*a*). Another important term, which will be employed when describing physical portions of the trim clip 10 of the invention, is the term 'radius bend'. The term radius bend is intended to indicate bends and gradual deformations provided as curves and or arches, so as to not overly stress and or crack a selected strip material at the point where such a gradual bend is provided. Accordingly, radius bends are gradual and rounded, for example possibly having a minimum (bend) radius of 1/16 of an inch. Examples of radius bends in accordance with the present invention can be found in the radius bends clearly shown in FIG. 5, which have radii designations R1 through R4, and corresponding inside bend angles A1 through A4. Accordingly, and out of functional necessity, radius bends of the invention are not sharp, creased, and or folded-material bends. It may also be noted that a radius bend of the invention may be provided to form each of "an upper arch and a lower inverted arch", indicating again that there is not a sharp v-shape bend, but one having a curved radius bend. The expression 'substantially fixed orientation' will refer to how a plurality of gripping fingers arranged in a 'triangular gripping pattern' will grip and hold an edge location of a siding member when installed upon the edge of the siding member. More specifically, once inserted into the gripping portion and engaged by the gripping fingers, the orientation of the trim clip with respect to the siding member will virtually always be the same. Further the triangular gripping pattern also results in a rigid gripping wherein the trim clip can not be significantly 'rocked', say up or down. Other important terms and definitions will be provided, as they are needed, to properly define the present invention and its associated novel characteristics and features. In addition, the terms and expressions employed herein have been selected in an attempt to provide a full and complete description of the invention. These terms may very well have equivalents known to skilled individuals, which may be long established in the art. As such, the chosen terminology is intended for illustration and completeness in description, and not for unduly limiting the scope of the invention.

Figure 3:
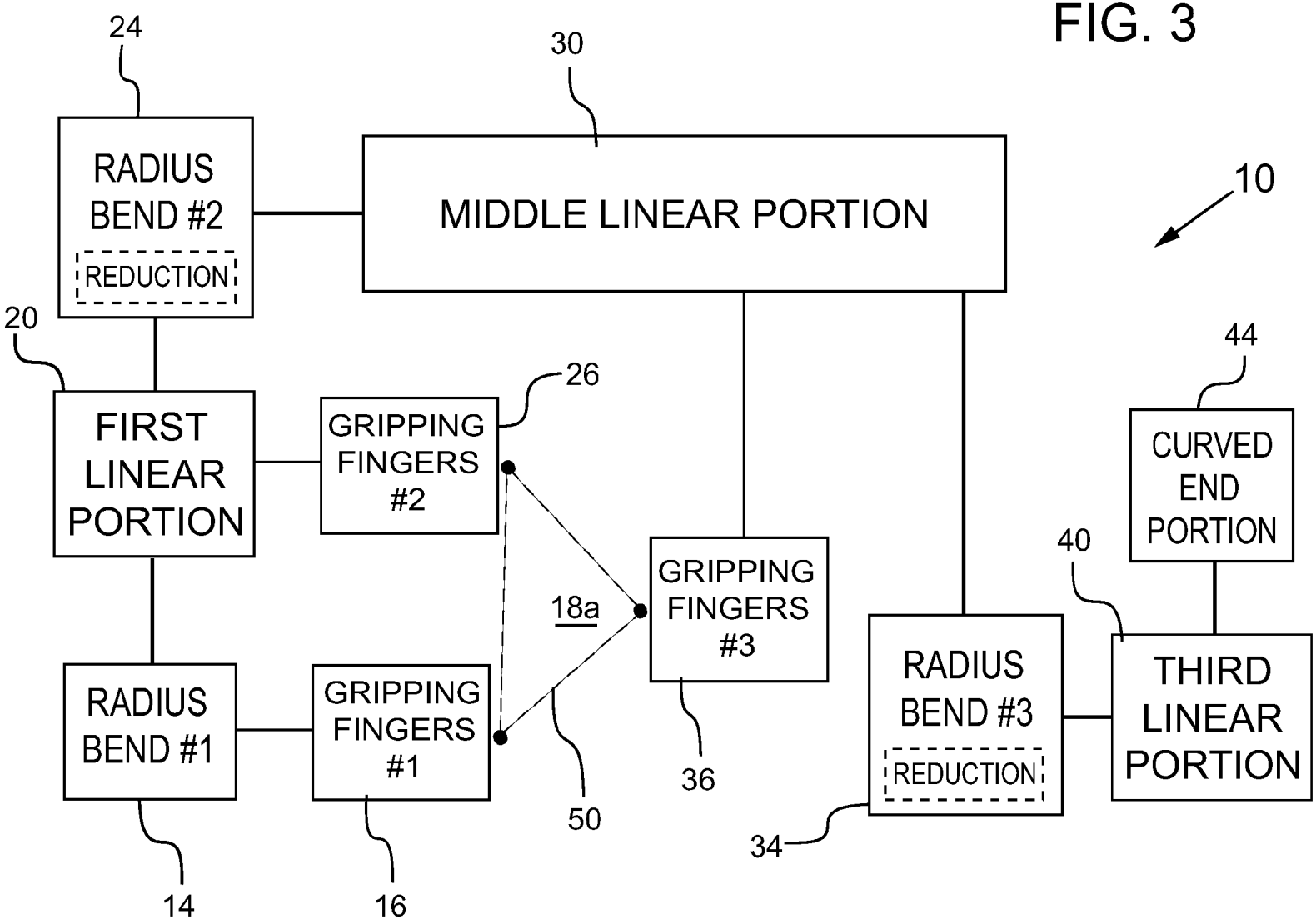
FIG. 3 depicts a high level generalized block diagram consistent with preferred embodiments of the trim clip of the invention.

Referring now to the drawings, FIG. 3 provides a high level generalized functional block diagram of a possibly most preferred embodiment of the present invention. As shown, a trim clip 10, may be formed with a plurality of distinct regions or portions, which in these most preferred embodiments may all be provided with a single formed length of a monolithic and continuous length of strip material. As shown in FIG. 3, a first substantially linear portion 20 has a first end having a first radius bend 14, which may also be termed a first inward radius bend, preferably ends with a plurality of gripping fingers 16. A second location for at least one gripping finger 26, is provided along the first substantially linear portion 20. A second end of the first substantially linear portion 20 leads to a second radius bend 24, which may also be termed an upper radius bend 24. As implied in FIG. 3, and clearly shown in several other figures, the upper radius bend 24 is interposed between and couples the first substantially linear portion 20 to an upper (left) end of the middle substantially linear portion 30.

Figure 5:
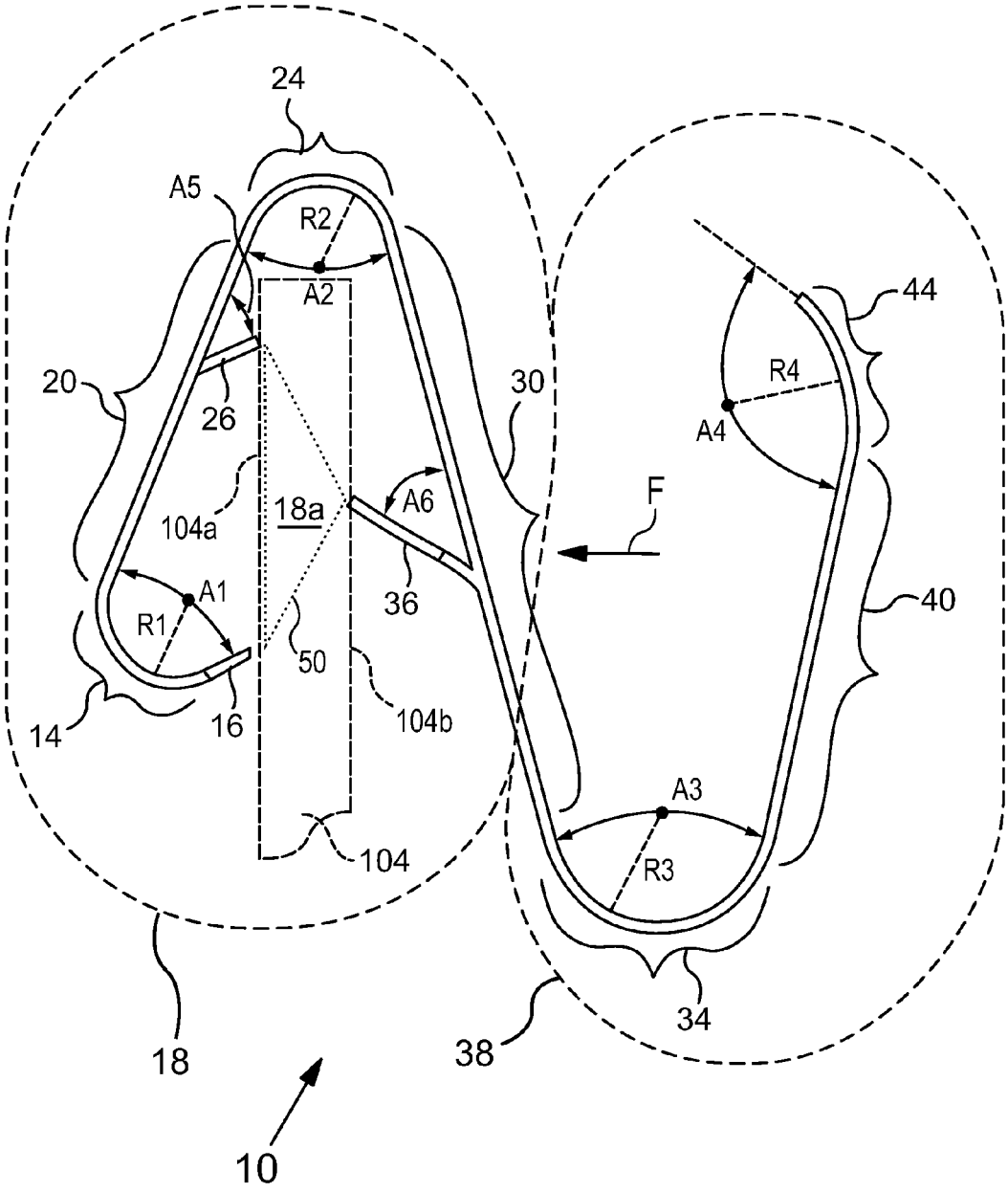
FIG. 5 is a side view of an embodiment of the trim clip of the invention, which is consistent with the depictions of FIGS. 3 through 4B, specifically defining a number of curved and linear regions, with a plurality of inwardly and upwardly depicted gripping fingers preferably structured to grip and secure the edge of a siding member with a triangular pattern.

Importantly, and as will be discussed when referring to FIG. 5, the first substantially linear portion 20, the upper radius bend 24 (bend #2), and the upper middle substantially linear portion 30 form a gripping portion 18, having an interior 18*a* for inserting and securing an edge or an edge location of a siding member. As indicated in FIGS. 3 and 5, the gripping fingers 16, 26, and 36, respectively, form a triangular gripping pattern 50. The triangular gripping pattern 50 is provided with at least two spaced gripping fingers structured for contacting and gripping a first surface 104*a* of a siding member 104, such as gripping fingers 16 and 26. As depicted in FIG. 3, and possibly better shown in FIG. 5, at least one other gripping finger 36 is structured for contacting the siding member 104 upon a second surface 104*b*, and at a location between where the first and opposite side gripping fingers contact the siding member. As shown in FIG. 5, gripping fingers 36 completes the 'triangular gripping pattern' of the present invention.

Returning to FIG. 3, a third radius bend 34 is provided at a lower (right) end of the middle substantially linear portion 30. This third radius bend 34, which may also be termed a lower radius bend 34, is interposed between and couples the second end of the middle substantially linear portion 30 to the third substantially linear portion 40. A curved end portion 44, which may also be termed a second inward radius bend, is formed at the second end of the third substantially linear portion 40, defining the second end of the trim clip 10. Again, as will be discussed hereinafter, a lower or second portion of the middle substantially linear portion 30, the third/lower radius bend 34, and the third substantially linear portion 40 will be termed a biasing portion 38. The biasing portion 38 is intended to bias an edge location of a siding member away from a wall structure 90 proximate to the edge location, while also aiding in holding and securing the trim clip 10, along with the edge location, within a finishing cavity.

Figure 4A:
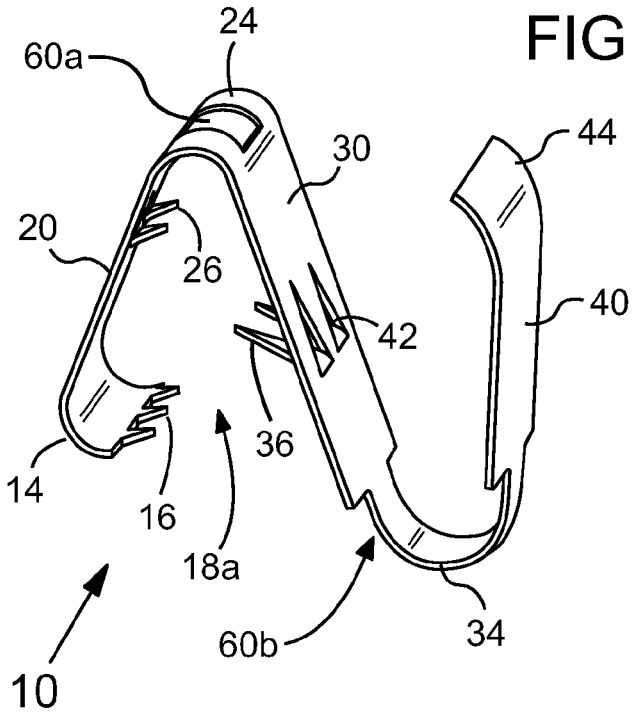
FIG. 4A and FIG. 4B each provide a perspective view of one possibly preferred embodiment of the invention.
Figure 4B:
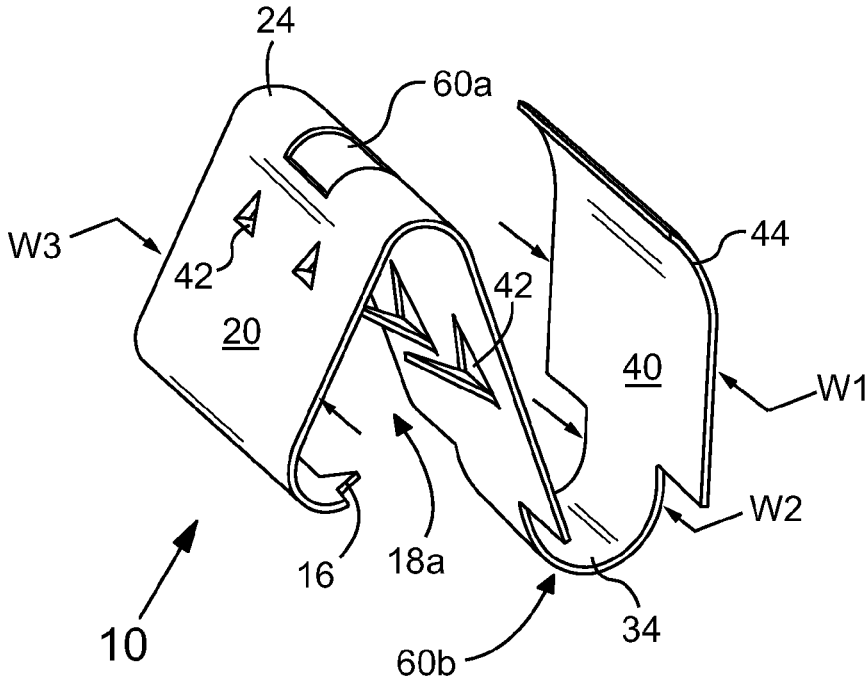

Turning now to FIGS. 4A, 4B, and 5, there is depicted a first actual embodiment of the trim clip 10 of the invention. As shown, the trim clip 10 is preferably provided having an N-shape, or equivalently a substantially (capital) N-shaped profile. As can be seen, the trim clip 10 includes a gripping portion 18 and a biasing portion 38 (as best seen in FIG. 5). As illustrated, the first gripping portion 18 may be formed by:

a) a first substantially linear portion 20 having a first (lower) end that establishes a first end of the trim clip 10, and includes the inward radius bend 14, ending in at least one gripping finger 16;

b) an upper radius bend 24 that is provided at the upper most portion of the first gripping portion 18; and c) at least an upper portion of the middle substantially linear portion 30, which is coupled to the first substantially linear portion 20 by way of the interposed upper radius bend 24.

Accordingly, the gripping portion 18 as shown may be said to include a curved upper arch, which provides an interior 18*a* that is structured for inserting and securing an edge or an edge location 106 of a siding member 104. Importantly, the depicted embodiments of FIGS. 4A, 4B, and 5, are specifically structured for accommodating siding members having a wide range of thicknesses. For example, a single embodiment of the present invention will readily handle siding members having a range of thickness of 1/32 of an inch to 1/4 of an inch.

Returning again to FIGS. 4A through 5, a biasing portion 38 of the trim clip 10 is further provided and structured for aiding in biasing an edge location of a siding member 104, upon which the trim clip 10 has been installed, away from a wall structure 90 to which the siding member 104 is being attached. It may be noted that the biasing member, which is fully located behind the siding member 104 and or a front facing surface of a finishing cavity when installed, will also aid in securing the trim clip 10 and the edge location of the siding member 104 within the pre-established and selected finishing cavity. Essentially the trim clip 10 and finishing cavity are mating structures that will securely maintain the upper edge of the siding member within the finishing cavity. Finishing cavities, which may best be provided by simple structures such as common J-channel trim 80 or L-channel trim, are typically located at vertical stops, such as under overhangs and under window frames/sills. A preferred biasing portion 38 of the invention may be formed by:

a) a lower portion of the middle substantially linear portion 30;

b) a third substantially linear portion 40, with the third substantially linear portion 40 structured having an inwardly curved end provided by a second inward curved end portion 44, which is formed at the second end of the trim clip 10; and c) a lower radius bend 34, that is interposed between and couples the lower portion of the middle substantially linear portion 30 and the third substantially linear portion 40, so as to form a lower inverted arch.

As can be clearly seen in FIGS. 4A, 4B, and 5, a plurality of gripping fingers, including gripping fingers 16, 26, and 36, are structured for extending inwardly and upwardly into the interior 18*a* of the upper arch for gripping onto the edge of the siding member 104. The term "inwardly and upwardly" is best quantified as a function of the material being inserted into the gripping portion 18. However, for commonly available siding materials the length of the gripping fingers (related to the inwardly aspect) may be best provided in the range of 0.08 to 0.20 inches. When considering the angle of the gripping fingers (related to the upwardly aspect), the gripping fingers may be structured with an upward relative angle (with respect to a selected horizontal reference) of 20 to 60 degrees. More directly, the angles A5 and A6 of FIG. 5 may best be provided as substantially 45 degrees. In addition, a graphical definition of the term "inwardly and upwardly" is clearly provided in the profile view of FIG. 5.

As clearly illustrated in FIG. 5, as well as FIG. 3, FIGS. 6A-6C, and FIGS. 7A-7C, the trim clip 10 provides a triangular gripping pattern 50 with at least two spaced gripping fingers structured for contacting and gripping a first surface 104*a* at the edge 106 of the siding member 104, proximate to an edge location. At least one other gripping finger is structured for contacting the edge of the siding member 104 upon a second surface 104*b*, and importantly at a location between where the first and opposite side gripping fingers contact the siding member—thereby forming the triangular gripping pattern 50 of the invention. This arrangement ensures that the edge of the siding member is secured firmly within the interior 18*a* of the gripping portion 18, and at a repeatable and substantially fixed orientation. That is, due to the use of a triangular gripping pattern 50, once the trim clip 10 is installed upon an edge of a siding member 104 (see FIGS. 6A through 6C), the trim clip 10 is positioned and maintained at a relatively fixed angle with respect to the surfaces of the siding member 104, reducing or substantially eliminating a rocking of the trim clip 10 upon the siding edge. This is an important feature for each of the following reasons:

a) The lack of rocking prevents the edge 106 of the siding material 104 from working free of the trim clip 10 (and finishing cavity);

b) When the trim clip 10 and edge location 106 of the siding material 104 are being installed within the finishing cavity, for example by an installation technician, the fixed and maintained orientation between the siding material and trim clip 10 will aid in a consistent insertion action each time a trim clip is fully forced into the finishing cavity; and c) Due to the short overall height of the clip (in the vertical direction), when considered relative to the panel insertion distance, the fixed orientation of the trim clip allows for siding members to be trimmed with a height that brings the edge of the siding material quite close to the top of the inner finishing cavity, enabling the present trim clip to be employed with common trim pieces, such as J-channel.

Therefore, while providing the triangular gripping pattern 50 of the present invention, as clearly depicted in FIG. 5, the present invention teaches a simple structure having a short vertical height (relative to other known trim clip structures). Further this short structure supports providing a plurality of triangular gripping patterns, that may be provided closely spaced and side by side (as illustrated), or alternately, triangular gripping patterns that may be somewhat or substantially spaced apart (not illustrated). As illustrated herein, the present trim clip 10 closely spaces the plurality of triangular gripping patterns 50 to save material and to provide a concentrated gripping location. As such preferred embodiments of the trim clip 10 of the invention may have a maximum width of, for example, 1/4 to 3/4 of an inch (See width W1 and width W3 of FIG. 4B). It may further be noted that the preferred width may actually be best determined by the specific type and thickness of the siding material to be gripped.

In addition, although the location of the gripping fingers may also be modified by the specific material to be gripped, one possibly most preferred arrangement would provide gripping fingers suitably spaced across the width of the trim clip 10 at each of the following locations:

a) at the end of the inwardly curved first end of the trim clip 10 b) proximate to the middle of the first substantially linear portion 20 of the trim clip 10; and c) proximate to the middle of the middle substantially linear portion 30 of the trim clip 10.

Regarding the manufacture of embodiments of the present invention, several structural considerations will lead to a more reliable and economical product. A first structural consideration employed with a most preferred embodiment of the trim clip 10 employs a metal forming technique, as depicted in FIGS. 4A and 4B. More specifically, the gripping fingers 26 of the first substantially linear portion 20 and gripping fingers 36 of the middle substantially linear portion 30 may be provided as angled pointy protrusions formed by well known metal forming techniques. As clearly illustrated, and understood by skilled persons, for each gripping finger provided as an angled pointy protrusion in this manner, a void and opening 42 results proximate to the pointy protrusion. Another structural consideration is the inclusion of one or more "reductions of strip material". For example, as shown in FIGS. 4A and 4B, a reduction of strip material may be provided in at least one of the upper radius bend 24 and the lower radius bend 34. As clearly shown in FIGS. 4A and 4B, the reduction of strip material may be provided as at least one of:

a) an cutout or opening 60*a* proximate to or within the upper and or the lower radius bend 34; and b) a reduction in width 60*b* (e.g., width W2 vs. width W1 or width W3 in FIG. 4B) of the strip material proximate to or within the upper or the lower radius bend 34.

As appreciated by skilled individuals, a reduction of material 60 at a radius bend such as the upper radius bend 24 or the lower radius bend 34, when included, enables the altering the flexibility of the strip material proximate to the associated upper or lower radius bend 34 at which the reduction of strip material is provided. Certainly, other approaches to alter the flexibility and stiffness may be employed for an equivalent result.

Returning to FIG. 5, it may be noted that the depicted reduced height (e.g., relatively short) trim clip 10 of the invention may preferably include acute angle bends with bend angles that are considerably less than 90 degrees. For example, when considering the upper radius bend 24, a preferred bend angle would be in the range of 30 to 45 degrees. Similarly, a preferred bend angle for the lower radius bend 34 may be formed with an acute angle bend in the range of 20 to 35 degrees. In addition, a typical radius for bends such as the upper radius bend 24 and the lower radius bend 34 may be in the range of 0.09 inches to 0.15 inches. A possibly most preferred radius bend (or radius bend length) for each of the upper radius bend 24 and the lower radius bend 34 would be 0.098 inches and 0.141 inches, respectively. Other bends such as the first end radius bend 14 may preferably be formed having a bend radius in the range of 0.09 inches to 0.15 inches and an inside bend angle in the range of 35 to 55 degrees. A most preferable first end bend 14 may be provided having an of 45 degrees. The second end of the trim clip 10, which is structured with an inwardly curved end portion 44, may be most preferably provided having a bend radius in the range of 0.15 inches to 0.30 inches and an inside bend angle in the range of 110 to 130 degrees (which is most preferably provided as 120 degrees). However, when considering other bends such as the bends provided at the first end of the trim clip 10, or at the second end of the trim clip 10, the inside bend angles and or bend radii may be altered, as needed.

As appreciated by skilled persons, the actual bend angles and bend radii employed for a respective bend, such as the upper radius bend 24 and lower radius bend 34, may be affected by the thickness of the siding material, as well as the actual material utilized to construct the trim clip 10 of the invention. For example, it is contemplated that a trim clip 10 may be formed of a strip material that is selected from the group consisting of at least one of: steel, stainless steel, aluminum, composite material, and fiberglass.

Figure 6A:
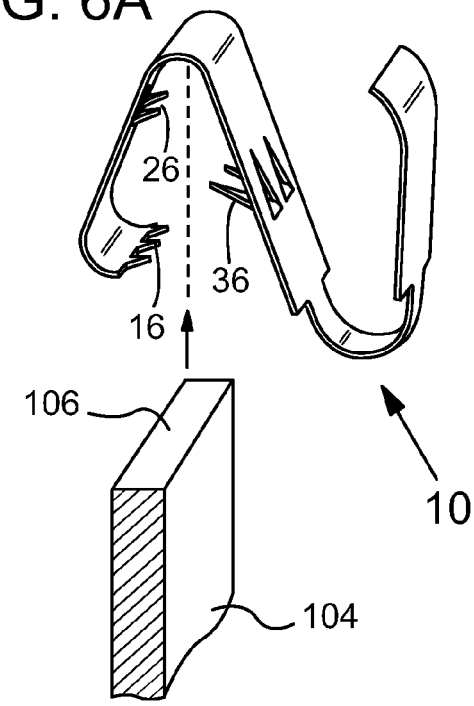
FIGS. 6A, 6B, and 6C provide a series or sequence showing how a trim clip of the invention is applied to and installed upon an edge location of a siding member (depicted as a slice of a siding member).
Figure 6B:
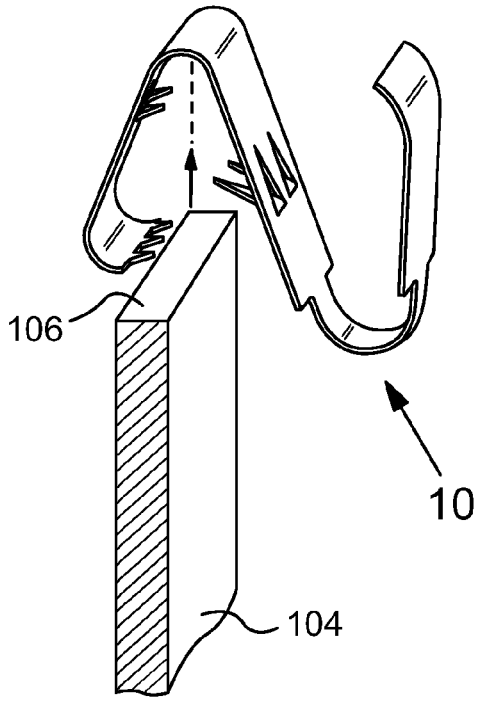
Figure 6C:
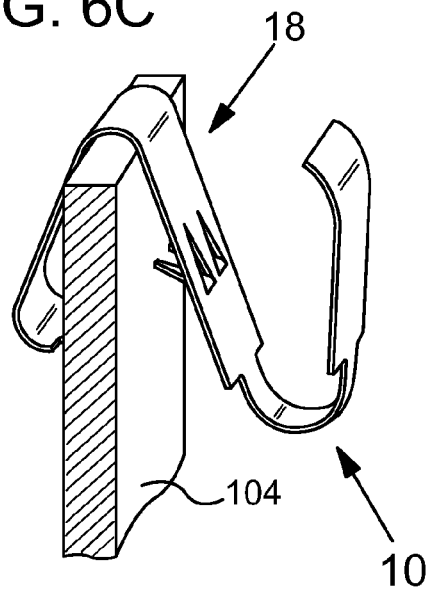

Turning now to FIGS. 6A-6C, and FIGS. 7A-7C, a series or sequence of activities is depicted for using the trim clip 10 of the invention. Each series of activities would typically be performed by a siding installation technician. FIG. 6A shows an edge location 106 of a siding member 104 (as a slice), wherein the edge location is going to be inserted into the gripping portion 18 of the trim clip 10. In FIG. 6B, the edge location 106 is just about to enter the interior 18*a* of the gripping portion 18, while in FIG. 6C the edge location of the siding member 104 has entered and is fully inserted into the gripping portion 18. It may be noted that the gripping fingers, for example as depicted in FIG. 6C, will preferably engage and grip the surfaces of the siding member 104 at this point. As will be seen in FIGS. 7A-7C, once inserted and secured within the finishing cavity, the gripping fingers may possibly grasp/grip the siding material 104 at the edge location 106 a bit more firmly.

Figure 7A:
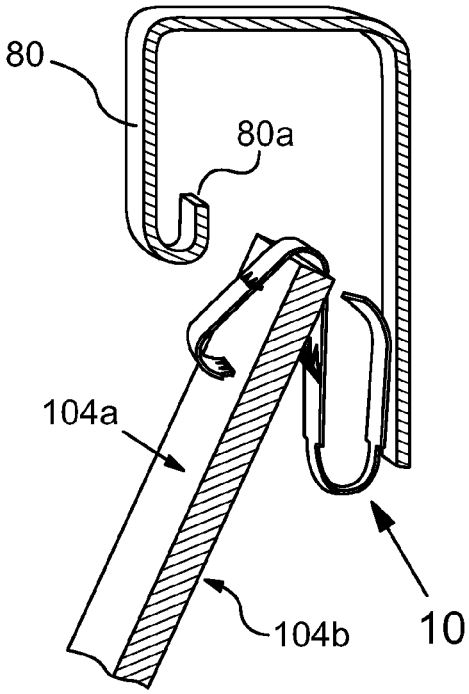
FIGS. 7A, 7B, and 7C illustrate a sequence of depictions showing how a trim clip that has been installed upon an edge location of a siding member may be installed into a trim member or trim piece, such as J-channel or L-channel trim pieces, for holding and securing the edge of the siding member therein.
Figure 7B:
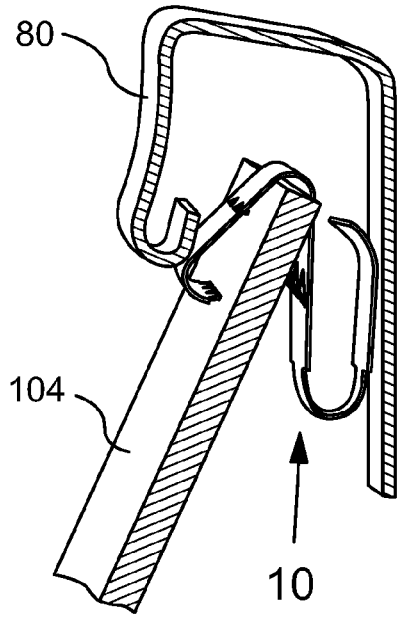
Figure 7C:
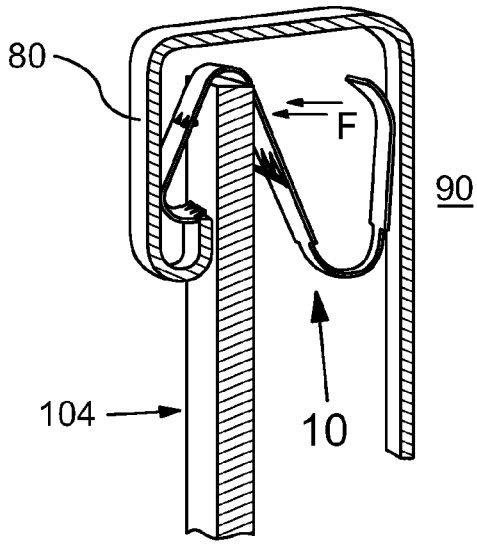

Turning to FIG. 7A, shown is a depiction of a slice of a siding member 104 with a trim clip 10 of the invention installed upon an edge location. Also shown in FIG. 7A, possible in an exaggerated depiction, is a bending of the third substantially linear portion 40 and the lower inverted arch, and a compressing of the biasing portion 38. FIG. 7B illustrates a trim clip 10 installed upon the edge location being pushed up, and be inserted into a finishing cavity (depicted as a slice of J-channel trim 80). The next view, as shown in FIG. 7C, shows the trim clip 10 gripping the edge location (via the triangular gripping pattern 50), while also being held and secured within the cavity. FIG. 7C, also provides a clear illustration of several important functions/features provided by the linear and curved portions of embodiments of the invention, including:

a) providing the inward radius bend 14 at the first end of the first substantially linear portion (and the trim clip 10), thereby enabling an engaging of a curved lip portion of the depicted J-channel trim slice, clearly aiding in holding and securing the trim clip 10 and the gripped edge of the siding member within the finishing cavity; and b) causing a biasing of the edge location of the siding member 104 away from a wall structure 90 (see FIG. 7C), and up against the front portion of the J-channel trim 80 and the curved lip portion thereof (via force arrows F), thereby providing aesthetic and securing results.

Figure 8:
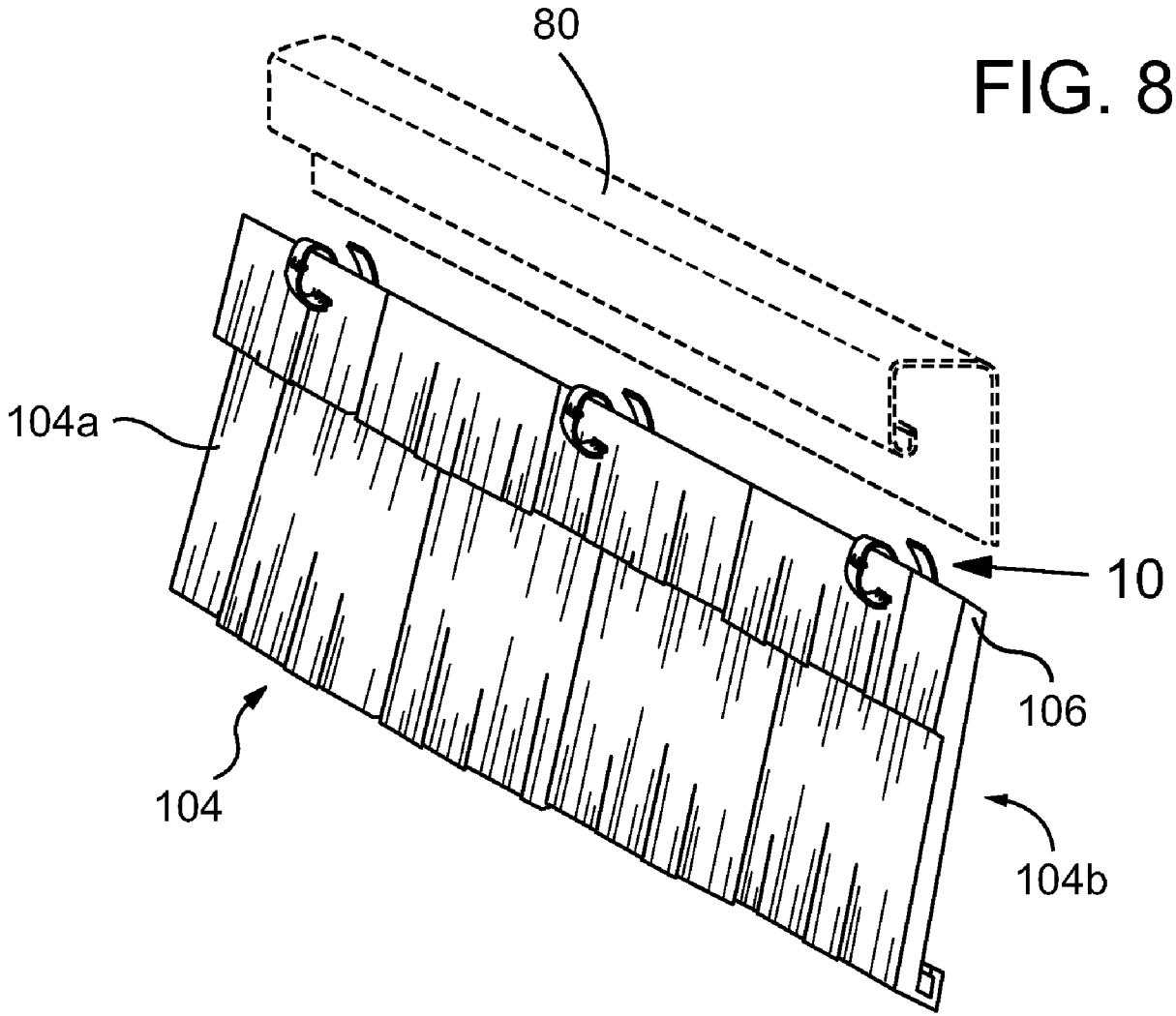
FIG. 8 provides a perspective view of a length of an edge of a siding member, with trim clips of the invention installed at regular intervals, say of 8 to 12 inches.

For clarity, and as illustrated in FIG. 8, an edge location of a siding member 104 would typically be held in place by a plurality of spaced trim clips 10, which would collectively be inserted into a finishing cavity (e.g., J-channel trim 80) providing for a distributed multi-point securing of the edge location. The arrangement of FIG. 8, coupled with the improved triangular gripping pattern 50 of the presently taught trim clip 10, provides for a firm securing of the trim clip 10, and thereby the edge of the siding member, in such a manner so as to withstand stressful conditions such as high winds. It may also be noted that the use of trim clips 10 shown in FIG. 8, is typical of how trim clips are typically deployed (along an edge). Finally, the use of the 'sliced depictions' of FIGS. 6A-6C and FIGS. 7A-7C, was employed for space and clarity considerations.

While there have been described herein a plurality of the currently preferred embodiments of the means and methods of the present invention, those skilled in the art will recognize that other and further modifications may be made without departing from the invention. For example, the first substantially linear portion 20, the middle substantially linear portion 30, and or the third substantially linear portion 40, may not be truly flat, and may include arcuate portions (such as depicted in FIG. 8). As such, the foregoing descriptions of the specific embodiments of the present invention have been provided for the purposes of illustration, description, and enablement. They are not intended to be exhaustive or to limit the invention to the specific forms disclosed and or illustrated. Obviously numerous modifications and alterations are possible in light of the above teachings, and it is fully intended to claim all modifications and variations that fall within the scope of the appended claims provided hereinafter.

What is claimed is:

1. A trim clip having a substantially N-shaped profile, comprising:

a) a first gripping portion including a curved upper arch having an interior for inserting and securing an edge location of a siding member, the first gripping portion formed by at least:

i) a first substantially linear portion establishing a first end of the trim clip, the first substantially linear portion structured having an inward radius bend formed proximate to the first end of the trim clip;

ii) an upper radius bend, provided at the upper most portion of the first gripping portion; and iii) an upper portion of a middle substantially linear portion, which is coupled to the first substantially linear portion by way of the interposed upper radius bend; and b) a biasing portion including a lower inverted arch including a lower radius bend, with the biasing portion provided to bias the edge location of siding member away from a wall structure proximate to the edge location, with the biasing portion formed by at least:

i) a lower portion of the middle substantially linear portion;

ii) a third substantially linear portion, which is coupled to the lower portion of the middle substantially linear portion by way of the lower radius bend, with the third substantially linear portion structured having an inwardly curved end portion, formed at the second end of the trim clip; and c) a plurality of upwardly facing gripping fingers, formed extending inwardly into the interior of the upper arch and structured for gripping onto the edge of the siding member as the edge is inserted into the interior of the upper arch.

2. The trim clip in accordance with claim 1, wherein the entire trim clip, including the first substantially linear portion, the upper radius bend, the middle substantially linear portion, the lower radius bend, and the third substantially linear portion with the curved end, are all formed of a continuous length of strip material having the N-shaped profile.

3. The trim clip in accordance with claim 1, wherein the gripping fingers of the gripping portion:

a) are arranged in a triangular gripping pattern with at least two spaced gripping fingers structured for contacting and gripping a first surface of a siding member, proximate to an edge location, while at least one other finger is structured for contacting the siding member upon a second surface of the siding member, and at a location between where the first and opposite side gripping fingers contact the siding member, forming the triangular gripping pattern;

b) with the triangular gripping pattern providing for an engaging and fixing of the edge of the siding member within the upper gripping portion at a substantially fixed orientation.

4. The trim clip in accordance with claim 3, wherein a plurality of triangular gripping patterns are provided closely spaced, and side by side, and realized by providing rows of spaced gripping fingers across the width of the trim clip, at each of:

a) the inwardly curved first end of the trim clip;

b) proximate to the middle of the first substantially linear portion of the trim clip; and c) proximate to the middle of the middle substantially linear portion of the trim clip.

5. The trim clip in accordance with claim 1, wherein the plurality of the gripping fingers upon each of the first substantially linear portion and the middle substantially linear portion are formed by a metal forming technique yielding a plurality of angled pointy protrusions extending inwardly into the interior of a gripping portion, while further providing a void and opening resulting from the forming of each pointy protrusion.

6. The trim clip in accordance with claim 1, wherein the strip material forming the entire trim clip is further structured having at least one of:

a) a reduction of strip material forming the upper radius bend; and b) a reduction of strip material forming the lower radius bend;

c) wherein the reduction of strip material is provided at least one of the upper radius bend and the lower radius bend, with the reduction of strip material realized by at least one of:

i) including an opening proximate to the upper radius bend or lower radius bend; and ii) including a reduction in width of the strip material proximate to the upper radius bend or the lower radius bend.

7. The trim clip in accordance with claim 1, wherein:

a) the upper radius bend is formed as an acute angle bend with an inside bend angle in the range of 30 to 45 degrees; and b) the lower radius bend is formed with an acute angle bend with an inside bend angle in the range of 20 to 35 degrees.

8. A siding trim clip formed of a single piece of strip material, structured having an N-shaped profile including a plurality of curved radius bends, the siding trim clip comprising:

a) an upper gripping portion including an upper arch having an interior into which a plurality of gripping fingers extend inwardly and upwardly, the first gripping portion further structured having:

i) a first substantially linear portion having a first end establishing a first end of the trim clip, with the first substantially linear portion provided having an inward radius bend formed proximate to the first end of the trim clip;

ii) an acute angle upper radius bend;

iii) at least an upper portion of a middle substantially linear portion, with the upper portion of the middle substantially linear portion coupled to the first substantially linear portion by way of the interposed acute angle upper radius bend; and b) a biasing portion including a lower inverted arch having an acute angle lower radius bend, with the biasing portion provided to bias an edge location of the siding member away from a wall structure adjacent to the edge location of the siding member proximate to a vertical stop, with the biasing portion formed by at least:

i) a lower portion of the middle substantially linear portion;

ii) a third substantially linear portion, establishing a second end of the trim clip and structured having an inward radius curved end portion, with the third substantially linear portion coupled to the lower portion of the middle substantially linear portion by way of the interposed acute angle lower radius bend;

c) wherein the plurality of inwardly and upwardly facing gripping fingers that extend into the interior of the upper gripping portion are structured to:

i) engage an edge location of the siding member, gripping the siding member upon each of an inner and outer surface of the edge location of the siding member; and ii) engage and grip the siding member using a triangular gripping pattern establishing a repeatable orientation between the gripping portion of the trim clip and the surfaces of the siding member;

d) wherein the trim clip, which is formed of a single piece of strip material, is further structured such that upon an installing of the trim clip upon an edge location of the siding member, and upon a subsequent inserting and securing of the trim clip and edge location into a pre-established elongated finishing cavity, a compressing of the trim clip is effected, causing the gripping fingers to further grip into the inner and outer surfaces of the edge location and to hold within the finishing cavity.

9. The siding trim clip in accordance with claim 8, wherein the gripping fingers of the trim clip include:

a) a plurality of gripping fingers formed and provided at a first end of the trim clip;

b) a plurality of gripping fingers provided as angled pointy protrusions, are arranged for extending from inner surfaces of the upper gripping portion that are formed by the first substantially linear portion and the middle substantially linear portion.

10. The siding trim clip in accordance with claim 9, wherein the pointy protrusion gripping fingers are provided from the strip of material forming the clip by way of a metal forming process.

11. The siding trim clip in accordance with claim 8, wherein the entire trim clip is formed of a continuous length of strip material having at least one of:

a) a reduction of strip material forming the acute angle upper radius bend; and b) a reduction of strip material forming the acute angle lower radius bend;

c) with each reduction, when included, altering the flexibility of the strip material proximate to the associated acute angle upper radius bend or acute angle lower radius bend at which the reduction is provided.

12. The siding trim clip in accordance with claim 11, wherein when the reduction of strip material that is provided at at least one of the acute angle upper radius bend and the acute angle lower radius bend is realized by at least one of:

a) including an opening within the acute angle upper radius bend or acute angle lower radius bend; and b) including a reduction in width of a length of the strip material proximate to the acute angle upper radius bend or the acute angle lower radius bend.

13. The siding trim clip in accordance with claim 8, wherein the specific material employed to form the trim clip is selected from the group consisting of one of:

a) steel;

b) stainless steel;

c) aluminum;

d) composite material; and e) fiberglass.

14. A substantially N-shaped siding trim clip formed of a continuous length of strip material and structured having a gripping portion and a biasing portion with each formed substantially devoid of sharp folds, creases, and sharp bends, with the trim clip structured for installing upon an edge location of a siding member, typically at a location resulting from a cutting of a siding member as required for installation of the siding member along a vertical stop, the trim clip comprising:

a) a first substantially linear portion having an inward acute angle radius bend formed proximate to a first end thereof, with the first end further providing at least one gripping finger extending from the first end;

b) a middle substantially linear portion, which is coupled to the first substantially linear portion by way of a curved acute angle upper radius bend formed having an inside bend angle in the range of 30 to 45 degrees, with the acute angle upper radius bend provided by way of a portion of strip material between the first substantially linear portion and the middle substantially linear portion;

c) a third substantially linear portion, which is coupled to the middle substantially linear portion at an end opposite to the first substantially linear portion, with the coupling of the middle substantially linear portion to the third substantially linear portion realized by way of an acute angle lower radius bend provided having an inside bend angle in the range of 20 to 35 degrees;

d) with the first, middle, and third substantially linear portions, together with the curved acute angle upper radius bend and the curved acute angle lower radius bend, substantially forming the N-shape of the n-shaped trim clip, and thereby providing an upper arched portion and a lower inverted arched portion;

e) wherein the first upper arched portion of the trim clip, which includes the first substantially linear portion, the curved acute angle upper radius bend, and at least a portion of the middle substantially linear portion, is structured having a plurality of inwardly and upwardly facing gripping fingers, with at least one finger formed proximate to and extending from each of the inwardly curved first end of the trim clip, the first substantially linear portion of the trim clip, and the middle substantially linear portion of the trim clip, with the gripping fingers arranged in a triangular gripping pattern, and structured for accepting, and securing therein, an edge location of a siding member that is inserted into the curved upper arched portion of the trim clip, with the securing effected by a plurality of the included gripping fingers gripping both sides of the edge location in the triangular gripping pattern; and f) wherein a second lower inverted arched portion of the trim clip includes a lower portion of the substantially linear middle portion, the acute angle lower radius bend, and the third substantially linear portion, and is structured to bias the edge location of the siding member outwardly and away from a wall structure of a building to which the siding member is installed upon, when the clip and the edge location are inserted into a pre-established elongated finishing cavity.

15. The trim clip in accordance with claim 14, wherein a plurality of triangular gripping patterns are provided closely spaced, side by side, and are realized by providing multiple gripping fingers at each of:

a) the inwardly curved first end of the trim clip;

b) a middle portion of the first substantially linear portion of the trim clip; and c) a middle portion of the middle substantially linear portion of the trim clip.

16. The trim clip in accordance with claim 14, wherein the entire trim clip is formed of a continuous length of strip material having at least one of:

a) a reduction of strip material forming the acute angle upper radius bend; and b) a reduction of strip material forming the acute angle lower radius bend.

17. The trim clip in accordance with claim 16, wherein when the reduction of material is provided at least one of the acute angle upper radius bend and the acute angle lower radius bend, the reduction is realized by at least one of:

a) including an opening proximate to the acute angle upper radius bend or acute angle lower radius bend; and b) including a reduction in width of the strip material proximate to the acute angle upper radius bend or the acute angle lower radius bend;

c) with each reduction, when included, altering the flexibility of the strip material proximate to the associated acute angle upper radius bend or acute angle lower radius bend at which the reduction is provided.

18. The trim clip in accordance with claim 14, wherein each of the acute angle upper radius bend and acute angle lower radius bend are formed with a bend radius in the range of 0.09 inches to 0.15 inches.

19. The trim clip in accordance with claim 18, wherein the first curved end of the first substantially linear portion is formed having a bend radius in the range of 0.09 inches to 0.15 inches and an inside bend angle in the range of 35 to 55 degrees.

20. The trim clip in accordance with claim 19, wherein the second end of the trim clip is structured with an inwardly curved end having a bend radius in the range of 0.15 inches to 0.30 inches and an inside bend angle in the range of 110 to 130 degrees.

* * * * *